United States Patent [19]

Boisvert

[11] 4,285,542

[45] Aug. 25, 1981

[54] DECK SEAT BRACKET

[76] Inventor: Ives L. Boisvert, 1200 - 72nd Ave. Northeast, Minneapolis, Minn. 55432

[21] Appl. No.: 4,174

[22] Filed: Jan. 17, 1979

[51] Int. Cl.[3] ..... A47C 11/00

[52] U.S. Cl. ..... 297/217; 297/451; 297/232; 52/8

[58] Field of Search ..... 297/451, 243, 440, 15, 297/217, 463, 232; 52/8, 9, 188

[56] References Cited

U.S. PATENT DOCUMENTS

| | | | |
|---|---|---|---|
| 855,817 | 6/1907 | Schoenecke . | |
| 897,371 | 9/1908 | Huebner | 297/451 |
| 1,618,803 | 2/1927 | Bokan | 297/451 |
| 2,025,088 | 12/1935 | Boller . | |
| 2,095,625 | 10/1937 | Allen . | |
| 2,171,374 | 8/1939 | Ryan et al. . | |
| 2,817,389 | 12/1957 | Richards | 52/8 |
| 2,987,111 | 6/1961 | Walworth | 52/9 |
| 3,352,069 | 11/1967 | Curra, Jr. | 52/9 |
| 3,974,894 | 8/1976 | Wenger et al. | 52/9 |
| 4,045,921 | 9/1977 | Molloy | 52/9 |

*Primary Examiner*—Francis K. Zugel

*Attorney, Agent, or Firm*—Kinney, Lange, Braddock, Westman & Fairbairn

[57] ABSTRACT

A bracket is connected to a base such as a deck and supports a seat and back joist of a bench-type seat. The bracket includes a quadrangular portion having a top, a bottom, and first and second sides. The bottom is connected to the top surface of the deck, and the top supports a plank which forms the seat of the deck seat. An L-shaped portion extends below the quadrangular portion for supporting the bottom end of a generally upstanding back joist. A loop is attached to the first side and receives and holds the upstanding back joist at a position above its bottom end. Back rest boards are connected between the upstanding back joists to provide the back of the bench-type seat.

8 Claims, 4 Drawing Figures

DECK SEAT BRACKET

BACKGROUND OF THE INVENTION

1. Field of the Invention

The present invention relates to seating devices. In particular, the present invention is a bracket for supporting a seat and back joist of a bench-type deck seat.

2. Description of the Prior Art

Bench-type seats are widely used in many different forms. Depending upon their use, bench-type seats are fabricated from a wide variety of materials and in many different configurations. The following U.S. patents show example of different forms of bench-type seats:

Schoenbecke—U.S. Pat. No. 855,817
Huebner—U.S. Pat. No. 897,371
Bokan—U.S. Pat. No. 1,618,803
Boller—U.S. Pat. No. 2,025,088
Allen—U.S. Pat. No. 2,095,625
Ryan et al—U.S. Pat. No. 2,171,374
Bayes—U.S. Pat. No. 3,584,916

There is a continuing need for inexpensive, simple-to-construct, sturdy, yet attractive bench-type seats which can be used in conjunction with decks, patios, benches, and the like. The construction of the bench-type seats should be as simple as possible, so that they can be assembled by the handyman doing a home improvement.

SUMMARY OF THE INVENTION

The present invention is a bracket used for assembling a bench-type seat. The bracket is extremely simple to install, and permits rapid assembly of the bench-type seat on a base such as a deck, a bench, or the like.

The bracket includes a generally horizontal top portion for supporting the seat, a generally horizontal bottom portion for connection to the top surface of the base, and first and second generally vertical side portions extending between the top and bottom portions. The bracket also includes a loop which receives a back joist and holds the back joist in a generally upstanding position. The bracket preferably includes an L-shaped portion which extends below the bottom portion to support the bottom end of the generally upstanding back joist.

To assemble a bench-type seat, two or more of the brackets are used at spaced positions. The seat is attached to the top portions of two of the brackets, and back support planks are attached between two of the upstanding back joists.

DETAILED DESCRIPTION OF PREFERRED EMBODIMENTS

Figure 1:
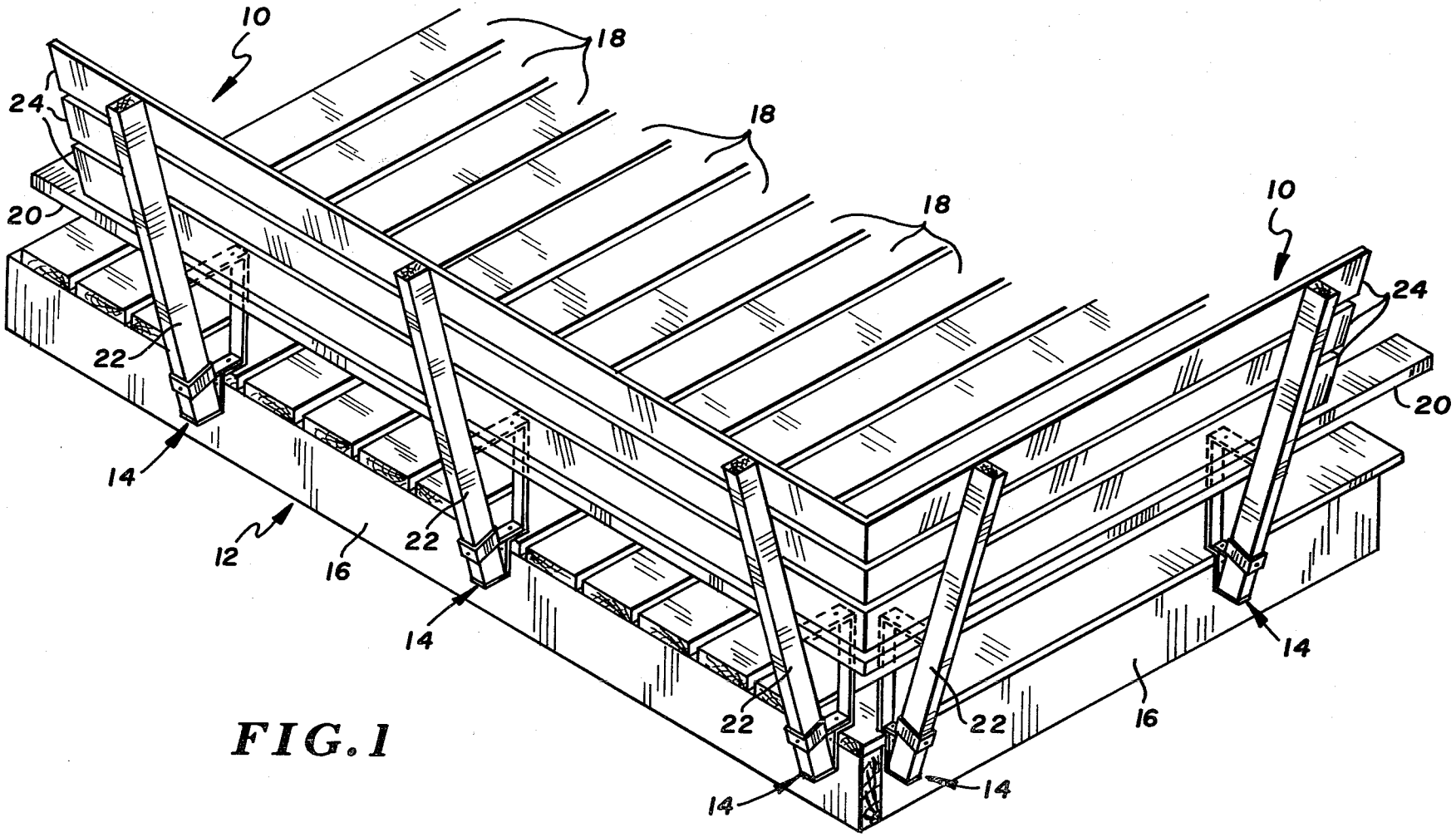
FIG. 1 is a perspective view showing a bench-type seat connected to an outdoor deck using the support brackets of the present invention.

FIG. 1 shows a bench-type deck seat 10 which utilizes the present invention. As shown in FIG. 1, deck seat 10 is supported above deck 12 by brackets 14, which are located at spaced positions around the periphery of deck 12.

Deck 12 is formed by deck joists 16, which are, for example, 2×8 or 2×10 joists set on edge. Deck planks 18 are arranged horizontally to form the top surface of deck 12. Deck planks 18 may be, for example, 2×4, 2×6, or 2×8 planks arranged side-by-side across the deck to form the top surface of deck 12.

Bench-type seats 10 include seat planks 20, which are attached to the top of brackets 14 and which extend between at least two of the spaced brackets. Seat planks 10 may be, for example, 2×8, 2×10, or 2×12 planks which are supported on the top of brackets 14.

The back portions of seats 10 include back joists 22, which are held by brackets 14 and which extend generally upwardly. As shown in FIG. 1, back joists 22 are slightly inclined with respect to vertical and support back support planks 24, which are attached and extend between the upstanding back joists 22. In one preferred embodiment, back joists 22 are 2×4 planks.

Figure 3:
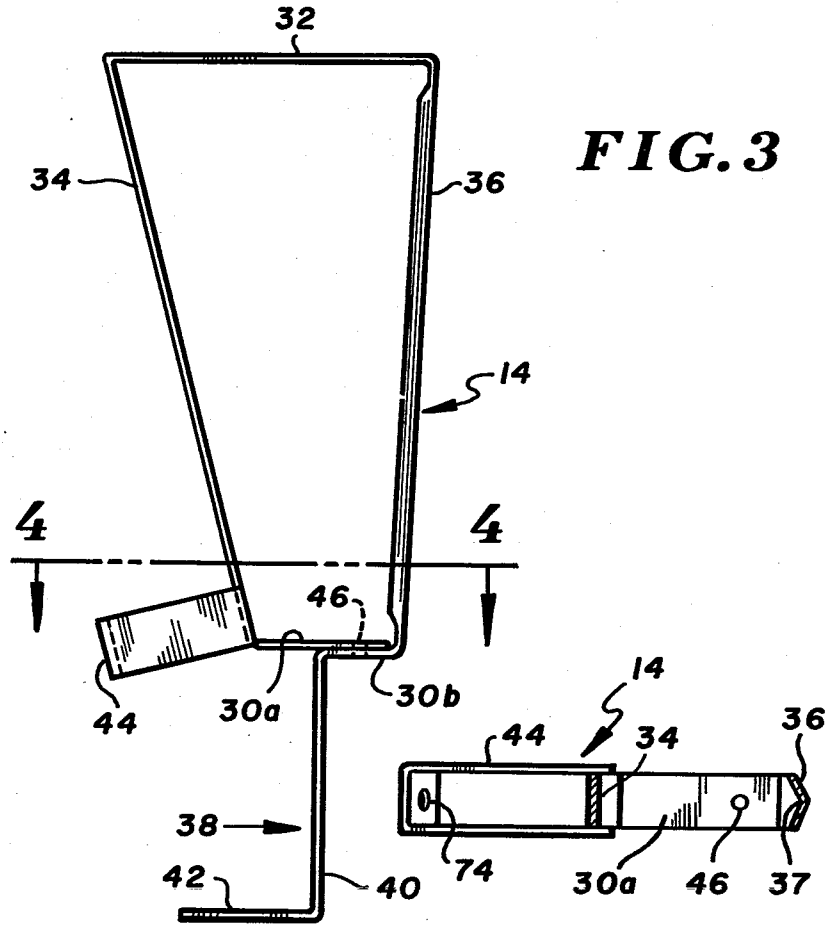
FIG. 3 is a side view of the bracket of the present invention.
Figure 4:
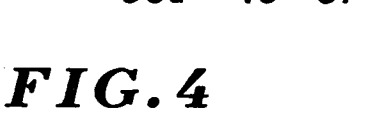
FIG. 4 is a cross-sectional view of the bracket along Section 4—4 of FIG. 3.
Figure 2:
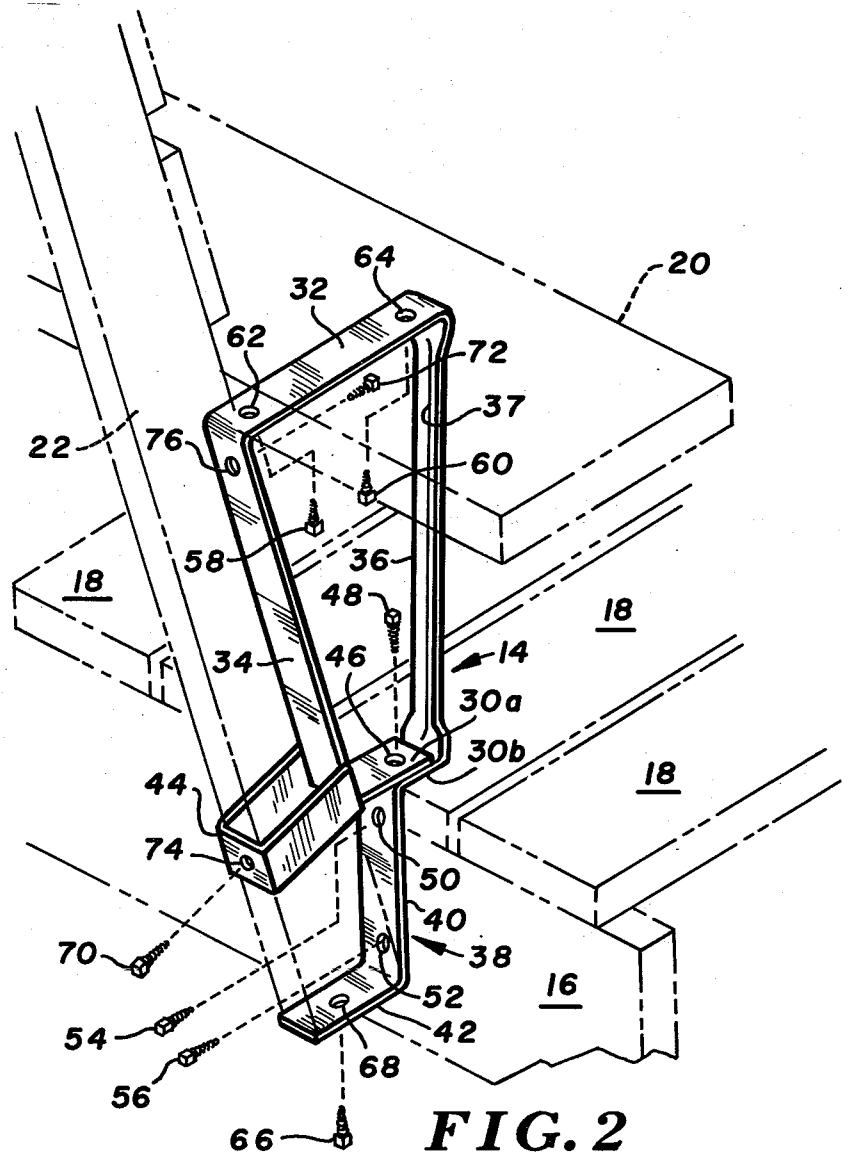
FIG. 2 is a perspective view showing the bracket of the present invention, with the deck, seat plank, back joist and back rest planks shown in phantom.

FIGS. 2, 3 and 4 show the support bracket of the present invention in greater detail. In the preferred embodiments shown in FIGS. 2–4, support bracket 14 is a metal bracket having a quadrangular portion formed by bottom 30, top 32, and first and second sides 34 and 36. Bottom 30 and top 32 are essentially parallel and are generally horizontal when bracket 14 is attached to deck 12. First side 34 is slightly inclined with respect to vertical at an angle which defines the angle of inclination of back joists 22. Second side 36, is essentially vertical and preferably has a vertical extending bend 37 which extends essentially the entire length of second side 36. Bend 37 provides additional strength in supporting seat 20 and the weight of the person or persons sitting on seat 20.

Extending downwardly from bottom 30 is an L-shaped member 38 having a downwardly extending portion 40 and an outwardly extending portion 42. In the preferred embodiments shown in FIGS. 2–4, L-shaped member 38 is formed of the same metal strip as bottom 30 and top 32 and first and second sides 34 and 36.

Loop 44 is connected to first side 34 of bracket 14 and has an opening large enough to receive and hold a back joist 22. Loop 44 is preferably secured to the rest of bracket 14 by welding, or by other suitable means.

Various screws attach bracket 14 to deck 10, and connect seat plank 20 and back joist 22 to bracket 14. Hole 46 in bottom 30 of the bracket permits screw 48 to connect bracket 14 to the top surface of deck plank 18. Holes 50 and 52, and screws 54 and 56 connect downwardly extending portion 40 to the side surface of the deck. As shown in FIG. 2, screw 54 extends into the end of the deck plank 18, while screw 56 extends into the side surface of deck joist 16.

Seat plank 20 is attached to bracket 14 by screws 58 and 60, which extend through holes 62 and 64, respectively, in top portion 32 of bracket 14.

In the embodiment shown in FIG. 2, back joist 22 has its bottom surface cut at an angle so that the bottom surface rests essentially flat and in contact with bottom portion 42 of bracket H, and so that one side of back joist 22 is parallel to and in contact with first side 34 of bracket 14. Screw 66 extends through hole 68 in bottom portion 42 to connect bottom portion 42 and the bottom end of back joist 22 together.

Back joist 22 is further held in position by screws 70 and 72. Screw 70 extends through hole 74 in loop 44. Screw 72 extends through hole 76 in first side 34.

From the Figures, it can be seen that the bracket of the present invention permits simple, rapidly constructed, rigid, rugged and attractive bench-type seats. Bracket 14 is attached to deck 12 by three screws (48, 54 and 56); seat 20 is connected to bracket 14 by two screws (58 and 60); and back joist 22 is supported by bottom support portion 42 and by loop 44 and is connected to bracket H by three screws (66, 70, and 72).

It can also be seen that the bracket of the present invention is low cost and easy to fabricate. It is formed of only two metal strips and can be fabricated using conventional metal working tools.

As illustrated in FIG. 1, the use of the bracket 14 of the present invention yields a deck seat around the edge of the deck which can replace the conventional deck railing. Bench-type seats 10 provide a large amount of seating around the deck, while also acting as a guard rail.

Although the embodiment specifically shown in FIG. 1 is a deck 12 to which the bench-type seats are attached, the present invention may also be used in conjunction with benches or other structures. All that is required is that bracket 14 be attached to a suitable base.

Although the present invention has been described with reference to preferred embodiments, workers skilled in the art will recognize that changes may be made in form and detail without departing from the spirit and scope of the invention.

What is claimed is:

1. A bracket for connection to a base having a top surface and a vertical side surface to support a seat and a back joist adjacent to the seat, the bracket comprising:

a generally horizontal top portion for supporting the seat;

a generally horizontal bottom portion for connection to the top surface of the base;

first and second generally vertical side portions extending between and connected to the top and bottom portions and supporting the top portion above the bottom portion;

a loop connected to the first generally vertical side portion adjacent to the connection to the bottom portion for receiving the bank joist and holding the back joist in a generally upstanding position; and a back joist support portion having a first downwardly extending portion below the bottom portion for connection with the vertical side surface of the base and a second outwardly turned portion, the second outwardly turned portion engaging and supporting a bottom end of the generally upstanding back joist.

2. The bracket of claim 1 wherein the generally horizontal top portion has a hole therein for permitting connecting means to connect the seat and the top portion, the generally horizontal bottom portion has a hole therein for permitting connecting means to connect the bottom portion and the top surface of the base, and wherein the loop portion has a hole for permitting connecting means to connect the back joist and the loop portion.

3. The bracket of claim 1 wherein the first generally vertical side portion is inclined with respect to vertical, and wherein the loop holds the generally upstanding back joist substantially parallel to the first generally vertical side portion.

4. A bracket for connection to a base having a top surface and a vertical side surface to support a seat and a generally upstanding back joist adjacent to the seat, the bracket comprising:

a quadrangular portion having a top for supporting the seat, a bottom having connecting apertures for connection to the top surface of the base, and first and second sides extending between the top and the bottom, the first side being inclined with respect to vertical;

an L-shaped portion extending below the quadrangular portion with an outwardly extending member for supporting a bottom end of a generally upstanding back joist and a downwardly extending member having apertures to permit connection to the vertical side surface of the base; and a loop positioned above the L-shaped portion for receiving the generally upstanding back joist at a position above its bottom end.

5. The bracket of claim 4 wherein the loop holds the back joist essentially parallel to the first side portion.

6. The bracket of claim 4 wherein the quadrangular portion and the L-shaped portion are a unitary metal member.

7. The bracket of claim 6 wherein the second side has a vertically extending longitudinal bend therein.

8. A deck seat for connection to a deck floor having a top surface and a vertical side surface, the deck seat comprising:

a plurality of brackets connected to the deck floor at spaced positions, each bracket comprising:

a quadrangular portion having a top, a bottom for connection to the top surface of the deck floor, and first and second sides extending between and connected to the top and the bottom, the first side being inclined with respect to vertical;

an L-shaped portion extending below the quadrangular portion having a downwardly extending portion for connection to the vertical side of the deck floor and an outwardly extending portion proximate a lower end of the downwardly extending portion; and a loop positioned above the L-shaped portion;

seat plank means supported on the tops of the quadrangular portions of each bracket and extending therebetween;

a plurality of back joists proximate the seat plank means extending through the loops of the brackets and being supported at its bottom end by the outwardly extending portions of the L-shaped portions of the brackets; and back support means connected to and extending between the back joists at a position above the brackets.

* * * * *